United States Patent [19]

Chu

[11] Patent Number: 4,486,637

[45] Date of Patent: Dec. 4, 1984

[54] PUSHBUTTON SWITCH ASSEMBLY

[75] Inventor: Pak J. Chu, Nepean, Canada

[73] Assignee: Northern Telecom Limited, Montreal, Canada

[21] Appl. No.: 394,495

[22] Filed: Jul. 2, 1982

[51] Int. Cl.[3] ..... H01H 13/70

[52] U.S. Cl. ..... 200/340; 200/159 B; 200/5 A; 200/292

[58] Field of Search ..... 200/340, 339, 335, 302, 200/293, 159 A, 159 B, 5 A, 292, 5 E, 5 B, 6 R; 84/423; 235/145 R

[56] References Cited

U.S. PATENT DOCUMENTS

| | | | |
|---|---|---|---|
| 3,916,135 | 10/1975 | Holden et al. | 200/339 |
| 3,941,953 | 3/1976 | Misson et al. | 200/5 A X |
| 3,996,429 | 12/1976 | Chu et al. | 200/5 A |
| 4,029,916 | 6/1977 | Chu | 200/5 A |
| 4,032,729 | 6/1977 | Kolstinen | 200/5 A |
| 4,066,860 | 1/1978 | Kawasaki | 200/5 A X |
| 4,084,071 | 4/1978 | Smith | 200/5 A |
| 4,160,886 | 7/1979 | Wright et al. | 200/5 A |
| 4,190,748 | 2/1980 | Langford | 200/5 A |
| 4,315,114 | 2/1982 | Monti, Jr. | 200/5 A |
| 4,323,740 | 4/1982 | Balash | 200/5 A |
| 4,368,364 | 1/1983 | Harbers, Jr. | 200/6 R |

FOREIGN PATENT DOCUMENTS

| | | | |
|---|---|---|---|
| 2459464 | 6/1975 | Fed. Rep. of Germany | 200/340 |
| 2403938 | 8/1975 | Fed. Rep. of Germany | 200/340 |
| 2445295 | 4/1976 | Fed. Rep. of Germany | 200/340 |

OTHER PUBLICATIONS

IBM Technical Disclosure Bulletin, vol. 19, No. 3, 8/76 "Sloped Key Button" Pierson.

IBM Technical Disclosure Bulletin, vol. 18, No. 3, 8/75 "Torsion Spring Actuator for a Key Switch" Harris.

*Primary Examiner*—Stephen Marcus

*Assistant Examiner*—Ernest G. Cusick

*Attorney, Agent, or Firm*—Thomas Adams

[57] ABSTRACT

A pushbutton switch assembly, for a keyboard, comprises a plurality of switch units each having at least a pair of superposed switch contacts, one of which is movable by an actuator to make or break contact. Each actuator is a hingedly mounted cantilever having a pushbutton at its free end. When the pushbutton is depressed an intermediate part of the cantilever actuates the movable switch contact. The cantilever is dimensioned so that the operating force needed at the pushbutton is only a fraction of that required to operate the switch contact directly. Also the pushbutton travel is correspondingly longer. Accordingly the assembly may use a relatively stiff, small travel type of switch unit, for example a snap-action spring plate or flexible membrane, yet provide at the pushbutton the "soft" action and long travel preferred by so many users. In order that this can be achieved without sacrificing the compactness desirable in a keyboard array, the distal end of one cantilever actuator is arranged to extend across the hinge axis of the next adjacent actuator. The part of the adjacent actuator proximal the hinge comprises a pair of arms spaced apart so as to accommodate such distal portion, at least when it is depressed.

9 Claims, 7 Drawing Figures

PUSHBUTTON SWITCH ASSEMBLY

The invention relates to pushbutton switch assemblies, especially for keyboards, such as for telephone dials or data input terminals.

Embodiments of the invention are especially applicable to pushbutton switches in which snap-action movable contacts carried by a flexible member, such as a membrane or spring plate, are depressed into contact with a subjacent circuit member. Such movable contacts are often preferred because they are cheap, reliable and compact. However, they often require a relatively large operating force, perhaps as much as 250 g., and/or the displacement of the movable contact in operation of the switch is quite small, for example 0.8 mm. These characteristics can be a disadvantage since many users prefer a pushbutton to have a "soft" action i.e. low operating force, and relatively long travel, as compared with the aforementioned movable contact. It has been proposed, for example in U.S. Pat. No. 4,029,916, to modify such characteristics by interposing a spring loaded plunger between the pushbutton and the movable switch contact. Such an arrangement is not entirely satisfactory, however, because of its relative complexity.

An object of the present invention is to provide a pushbutton switch assembly, for a keyboard, in which the pushbutton depression force is a portion only of that required to directly actuate the associated switch contacts and there is a corresponding increase in pushbutton travel; and to do so without necessarily increasing the pitch between adjacent pushbuttons beyond that between their respective contacts.

According to the present invention a pushbbutton switch assembly suitable for a keyboard, comprises a plurality of switch units, each unit having a pair of superposed switch contacts, one of said pair of switch contacts being movable relative to the other of said pair to make or break contact;

a plurality of actuators, one for each switch unit, each actuator comprising a lever having a pushbutton at its distal portion and a proximal part connected by a hinge for pivotal movement relative to said switch units, such that depression of said pushbutton causes a part of said lever intermediate the pushbutton to displace the movable contact said distal portion of one of said actuators extending across the hinge axis of an adjacent actuator;

wherein said proximal part of said adjacent actuator comprises a pair of arms spaced apart along its hinge axis to accommodate said distal portion of said one actuator between said arms, at least when said distal portion is in the depressed position.

The distal end portion of the one actuator may overlap part of the adjacent actuator, for example the intermediate part which displaces the movable contact.

Each actuator may be hingedly connected to a cover member securable over a base member which supports the switch units.

In one embodiment the cover and base member cooperate to form a chamber which houses the actuators. Recesses are provided in the chamber interior sidewalls and serve as bearings for pivot pins projecting laterally from opposite sides of each of the actuators.

The proximal part of each actuator may then comprise an open box-like structure comprising two sidewalls, an endwall and a bottom. The intermediate part serving to displace the movable switch contact may comprise a stud projecting from the underside of the bottom. The two sidewalls, and extensions thereof projecting beyond the bottom, comprise said bifurcation. The distal end portion then comprises a flange projecting from the upper edge of said endwall, and extending between the sidewalls of the adjacent actuator. The thickness of the flange may be less than the depth of the box endwall by an amount permitting full depression of the flange between the sidewalls to operate its switch. Then the flange may also overlap the bottom of the box.

Instead of pivot pins and bearings, the pivotal connection of each actuator may be by one or more flexible webs, conveniently formed as a reduced cross-section extension of the proximal end of the actuator.

In one particularly compact, low profile embodiment, the actuators comprise integral parts of a generally flat cover plate, which overlies the base member to form a sandwich. Each actuator comprises a medial-part formed as an area of the plate segregated by slots for most of its periphery from an adjacent actuator part or parts and a surrounding flat area of the plate. This medial part is connected to the surrounding area only by a pair of spaced-apart arms constituting the bifurcated proximal part of the actuator. Each arm is connected at one end to the surrounding area by a flexible web which serves as a hinge. Thus each medial part can flex independently out of the plane of the surrounding plate area. Each pushbutton comprises a distal part, thicker than the medial part, so as to protrude upwards therefrom.

Exemplary embodiments of the invention will now be described with reference to the accompanying drawings, in which.

Referring to FIGS. 1 to 4, a pushbutton switch assembly, for a keyboard, comprises four cantilever actuators 10, 12, 14 and 16 hingedly mounted in a row between a cover 18 and a flat composite base member 20 which carries a corresponding row of four switch contact units. A thin sheet 22 of, for example, polythene covers the surface of the base member 20 to limit ingress of dirt and moisture to the switch contacts.

Figure 1:
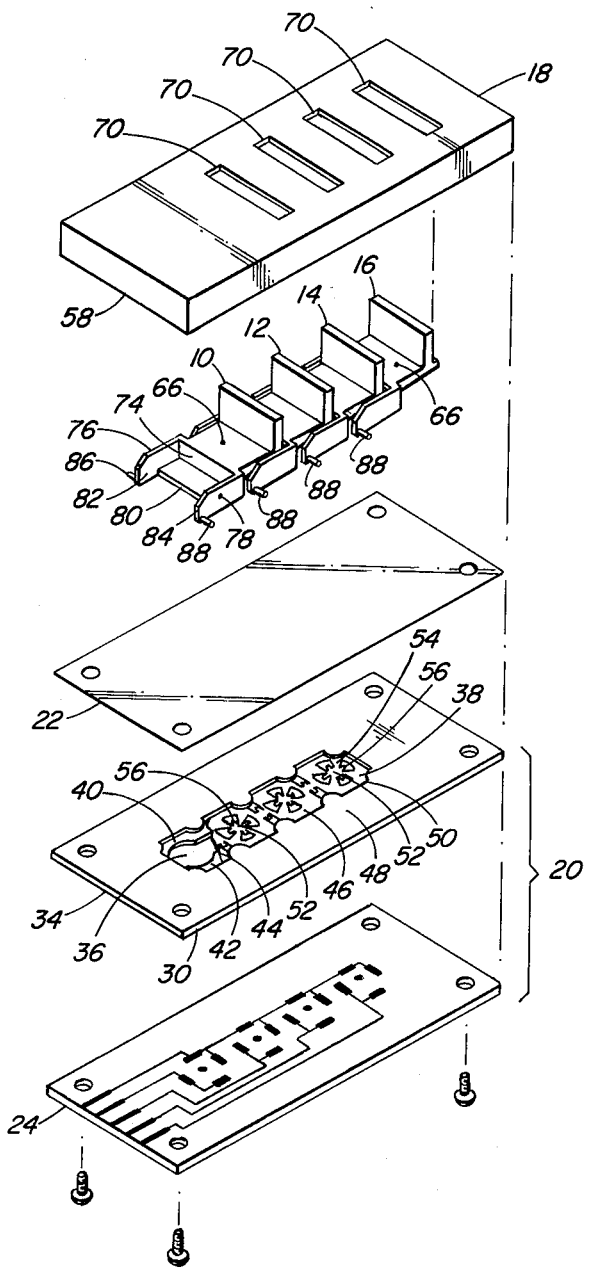
FIG. 1 is an exploded perspective view of one embodiment of the invention, specifically comprising a four pushbutton keyboard.
Figure 2:
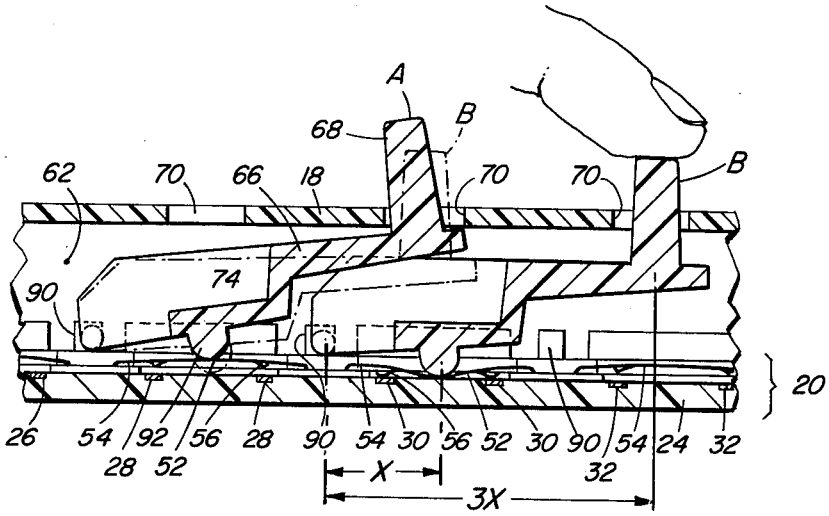
FIG. 2 is a cross-sectional view of part of the keyboard of FIG. 1, assembled.
Figure 3:
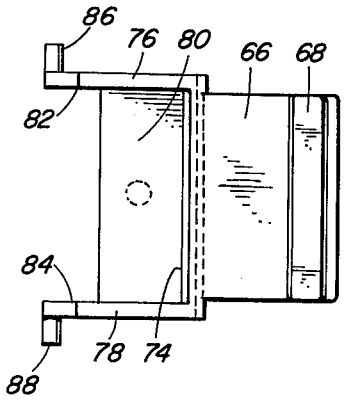
FIGS. 3 and 4 are plan and side views, respectively, of an actuator for the keyboard.
Figure 4:
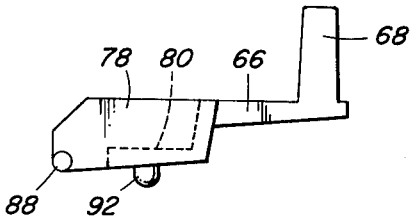

The composite base member 20 comprises a printed circuit board 24 carrying a row of four sets 26, 28, 30 and 32, of fixed contacts (see FIG. 2). The fixed contacts comprise contact areas formed on a central region of the circuit board 24 and connected by circuit lines to edge terminals (not shown). A flat sheet 34 of insulating material overlies the printed circuit board 24 and has a central elongate aperture 36 through which the fixed contact sets 26 to 32 are exposed.

A spring contact plate 38 is located in the aperture 36, being supported at its edges by lips 40 and 42 projecting inwardly from the longitudinal sidewalls of the aperture 36. The plate 38 comprises four interconnected square sections 44, 46, 48 and 50, each overlying one of the sets of fixed contacts 26 to 32. Each of the square sections 44 to 50 comprises a central movable contact portion 52 connected to a surrounding flat area by radial flexible webs 54. Each movable contact portion 52 comprises four radial contact arms 54, shorter in length than the radial connecting webs 54, and extending slightly downwards towards the underlying printed circuit board 24. The radial connecting webs 54 are prestressed to support the central portion 52 above the plane of the surrounding flat area of the plate 38 but to snap-through the plane when downward pressure is applied to the central portion 52 whereupon the extremities of the radial contact arms 56 contact the related fixed contact areas on the printed circuit board 24. For more detailed description of the construction and operation of such a spring contact switch plate, the reader is directed to U.S. Pat. No. 4,029,916 which is incorporated herein by reference.

The cover 18 has a peripheral depending rim 58 and the composite base member 20 is secured to the bottom edge of the rim 58, for example, by screws, forming a chamber 62 which contains the actuators 10 to 16.

Each of the actuators 10 to 16 is mounted as a pivotal cantilever, inclined slightly to the base member 20. Its distal end portion comprises a flange 66 from which a pushbutton 68 projects through a corresponding one of a row of holes 70 in the cover 18. The proximal part of each cantilever actuator comprises an open box structure formed by an end wall 74, depending perpendicularly from flange 66, opposite sidewalls 76, 78 and a bottom part 80. The sidewalls 76 and 78 have extensions 82 and 84, respectively, projecting beyond the bottom part 80. Pivot pins 86 and 88, having a common pivot axis, project outwards from extensions 82 and 84, respectively, each to engage in a bearing recess 90 (see FIG. 2) in the adjacent longitudinal sidewall of the cover 18. Each actuator has a stud or pin 92 projecting from the underside of its bottom part 80. Each pin 92 rests the central portion 52 of the associated movable switch contact. Thus, when the pushbutton part 68 is pressed, the actuator pivots downwards and the pin 92 depresses the moving contacts into contact with their counterparts fixed on the printed circuit board.

The width of the distal flange 66 of each actuator is less than the spacing between the sidewalls 76, 78 of the proximal part. The actuators nest longitudinally with the distal flange 66 of one actuator accommodated between the sidewalls 76, 78 of the next actuator in the row. Thus, the distal part of the one actuator extends across the pivotal axis of the next, also partly overlapping its bottom part 80. As shown clearly in FIG. 2, sufficient clearance is left between the overlapping flange 66 and bottom part 80 to permit adequate depression of each actuator to operate its switch contacts i.e. from position A to position B as indicated in FIG. 2.

As also indicated in FIG. 2, the pitch between the pushbutton and the pivot is three times that between the actuator in 92 and the pivot. Thus the force required to depress the pushbutton will be about one third that exerted by the actuator pin. The pushbutton travel will be correspondingly longer than that of the pin. With the particular spring plate described, such proportions have been used to give a pushbutton force of about 80 g. and travel of aout 3.5 mm.

Figure 5:
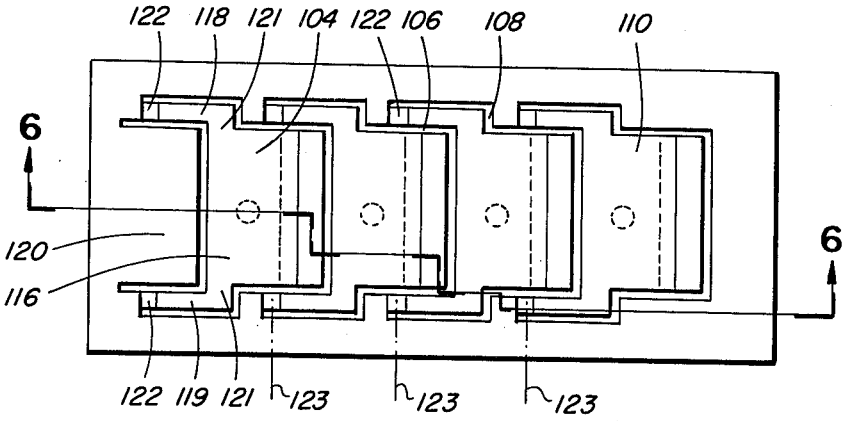
FIGS. 5, 6, and 7 are plan and sectional side elevations, respectively, of a cover part of a second embodiment of the invention.
Figure 6:
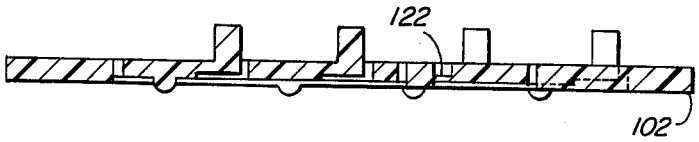
Figure 7:
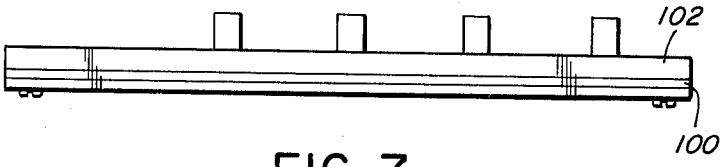

Referring now to FIGS. 5, 6 and 7, a second embodiment of the invention comprises a composite base member 100 (see FIG. 7), constructed like that of the first embodiment or the alternatives proposed hereafter. In the second embodiment however, the cover 102 comprises a flat plate secured to the base member 100 to form a sandwich structure. Four actuators 104, 106, 108 and 110 are provided in a row, again overlying the associated switch contacts (not shown). Each actuator is again in the form of a cantilever hinged at one end. In this embodiment however, they are formed integrally with the cover plate 102, conveniently as a moulding.

Each of the actuators 104 to 110 comprises a pushbutton 112 protruding upwards from adjacent its distal end and an actuator pin 114 protruding downwards at an intermediate position to impinge upon an underlying movable switch contact. The pushbutton 112 and pin 114 of each actuator protrude from a flat rectangular medial portion 116 which is connected to the surrounding parts of the cover plate by a pair of arms, 118 and 119 extending longitudinally one from each side of the rectangular portion 116.

Each arm 118, 119 is offset outwardly to lie outside the rectangular portion 116 of the preceding actuator in the row or, in the case of the first actuator, outside an equivalent rectangular portion 120 at the end of the cover plate.

Each arm 118, 119 is connected at one end by a short lateral stub 121 to the side of the rectangular portion 116 and at its other end is connected to the surrounding part of the cover plate 102 by a short flexible web 122. The flexible webs 122 each comprise a reduced cross-section continuation of one of the arms 118, 119 and have a common pivot or hinge axis 123 perpendicular to the length of the row of actuators. It will be observed from FIGS. 5 and 6 that in this embodiment the actuators are again aranged in nesting longitudinal configuration, the distal portion of one extending between the hinge arms of the next and hence across its hinge axis. However, in this embodiment there is no overlapping.

The thickness of each rectangular portion 116 is less than that of the surrounding part of the cover plate. The upper surface is coplanar, the underside of the cover plate consequently being recessed in the area overlying the spring plate contacts.

It will be appreciated that instead of the hinge parts being formed as reduced cross-section continuations of the arms 118, 119, the arms themselves might serve as the flexible hinge parts, depending upon the resilience of the material and dimensional constraints for the arms.

It should be noted that in both described embodiments, the pitch between adjacent pushbuttons is the same as that between adjacent movable switch contact sets. However, the nesting configuration, whereby the distal part extends across the adjacent pivotal axis, allows the effective length of each actuator to be greater than the pushbutton spacing. Therefore, despite its advantageous reduction in operating force and increased pushbutton travel, a keyboard embodying the invention need not be longer than such a conventional keyboard in which the pushbuttons are vertically aligned with the related switch contacts.

A further advantage of embodiments of the invention is that the relative spacing of the pushbutton and actuator pin from the pivotal axis can be readily varied during design to accommodate different operating characteristics of the movable switch contacts. This facilitates substitution of different types of contact members, such as a flexible membrane in which the movable contacts are coated on the interior of a bubble or dome.

What is claimed is:

1. A pushbutton switch assembly, for a keyboard, comprising:

a base member;

a cover therefor, cooperating with the base member to form a chamber;

a plurality of switch units between the base member and the cover, each switch unit having a pair of superposed switch contacts, one of said pair of switch contacts being movable relative to the other of said pair to make or break contact;

a plurality of actuators housed in said chamber, one actuator for each switch unit, each actuator being in the form of a lever having a proximal part whereby the lever is hingedly mounted for pivotal movement relative to said base member, a distal part including a pushbutton part protruding through a corresponding hole in said cover, and, between said proximal part and said distal part, an intermediate part serving to displace said one of said pair of switch contacts when said pushbutton part is depressed;

wherein said proximal part comprises an open box-like formation formed by an endwall, two sidewalls, and a bottom, such sidewalls being spaced apart along the pivotal axis of said lever, and said distal part comprises a flange projecting from an upper edge of said endwall and away from the hinge axis, the arrangement being such that the flange of one actuator projects across the hinge axis of the adjacent actuator and is accommodated between the sidewalls of such adjacent actuator, at least when the pushbutton part of said one actuator is depressed.

2. A pushbutton switch assembly as claimed in claim 1, wherein said distal portion overlaps a part of said adjacent actuator.

3. A pushbutton switch assembly as claimed in claim 2, wherein the part overlapped by said distal portion comprises said intermediate part serving to displace said one of said pair of switch contacts.

4. A pushbutton switch assembly as claimed in claim 2, wherein said flange of said one of said actuators overlaps and is spaced from said bottom of said adjacent actuator, said part serving to displace the switch contact comprising a protruberance protruding from said bottom.

5. A pushbutton switch assembly as claimed in claim 2, wherein each actuator is hingedly connected to said cover by spigots engaging in bearing recesses.

6. A pushbutton switch assembly, for a keyboard, comprising:

a base member;

a cover therefor comprising a substantially flat plate;

a plurality of switch units between the cover and the base member, each switch unit having a pair of superposed switch contacts, one of said pair of switch contacts being movable relative to the other of said pair to make or break contact; and a plurality of actuators, one for each switch unit, each actuator being a discrete part of said plate, segregated for most of its periphery from the remainder of the plate so as to form a lever having a distal part serving as a pushbutton part, a proximal part hingedly connected for pivotal movement of the lever relative to the plane of said plate, and between said proximal part and said distal part, an intermediate part serving to displace said one of said pair of switch contacts when the pushbutton is depressed, said distal part of one of said actuators extending across the hinge axis of an adjacent actuator, said proximal part of said adjacent actuator comprising a pair of arms, said actuator being attached to said remainder of said plate by a pair of flexible hinges, each connecting a respective one of said pair of arms, said arms being spaced apart along the hinge axis and accommodating said distal part of said one actuator therebetween, at least when said distal part is in the depressed position.

7. A pushbutton assembly as claimed in claim 6, wherein each flexible hinge comprises a flexible web.

8. A pushbutton switch assembly as claimed in claim 1 or 6, wherein said one of said pair of switch contacts is carried by a resiliently flexible member overlying a circuit member, said other of said pair of switch contacts comprising a contact area on said circuit member.

9. A pushbutton switch assembly as claimed in claim 8, wherein said resiliently flexible member comprises a spring plate and said circuit member comprises a printed circuit board, the spring plate being supported in proximity to said printed circuit board by an insulating carrier.

* * * * *